US010435237B1

(12) United States Patent
Schmeck

(10) Patent No.: US 10,435,237 B1
(45) Date of Patent: Oct. 8, 2019

(54) GARBAGE BAG SLING

(71) Applicant: Deborah Schmeck, Stevens, PA (US)

(72) Inventor: Deborah Schmeck, Stevens, PA (US)

( * ) Notice: Subject to any disclaimer, the term of this patent is extended or adjusted under 35 U.S.C. 154(b) by 80 days.

(21) Appl. No.: 15/877,477

(22) Filed: Jan. 23, 2018

(51) Int. Cl.
*B65F 1/06* (2006.01)
*B65B 67/12* (2006.01)
*B65D 63/18* (2006.01)

(52) U.S. Cl.
CPC ..... *B65F 1/068* (2013.01); *B65B 67/1222* (2013.01); *B65D 63/18* (2013.01)

(58) Field of Classification Search
CPC ..... B65F 1/00–068; B65B 67/00–1222; B65D 63/00–18; B65D 5/6647; B65D 5/6673; B65D 45/16; B65D 90/205; B65D 2571/00944
See application file for complete search history.

(56) References Cited

U.S. PATENT DOCUMENTS 1,971,642 A 8/1934 Champlin
3,779,156 A 12/1973 Race
4,140,257 A 2/1979 Peterson
5,590,804 A * 1/1997 Crum ..... A47J 47/20 220/23.86
5,641,189 A 6/1997 Landman
5,803,299 A * 9/1998 Sealy, Jr. ..... B65F 1/062 220/495.07
5,915,584 A * 6/1999 Sposit ..... B65B 67/1227 220/495.09
5,944,423 A * 8/1999 Rabin ..... B42F 15/0035 229/67.2
6,079,759 A 6/2000 Payne
6,132,088 A * 10/2000 Suzuki ..... B65D 90/046 220/482
6,176,455 B1 * 1/2001 Ma ..... B65B 67/1233 141/391
6,394,297 B1 * 5/2002 Nance ..... A47G 19/04 220/23.4
6,607,088 B2 * 8/2003 Cestrone ..... B65F 1/141 220/23.86
7,273,155 B1 * 9/2007 Gray ..... B65F 1/06 220/495.04
7,591,060 B2 9/2009 Shalit
D629,110 S 12/2010 Brettle
(Continued)

FOREIGN PATENT DOCUMENTS

CA 2650728 A 7/2010

*Primary Examiner* — Kareen K Thomas
(74) *Attorney, Agent, or Firm* — Kyle A. Fletcher, Esq.

(57) ABSTRACT

The garbage bag sling comprises a plurality of webbings, a plurality of fasteners, a plurality of hooks, a plurality of handles, a mesh sheeting, and a plurality of seams. The plurality of seams are used to interconnect the plurality of webbings, the plurality of fasteners, the plurality of handles, and the mesh sheeting. The plurality of fasteners attach the plurality of hooks to the interconnected structure. The plurality of hooks attach the garbage bag sling to the waste container. The garbage bag sling is placed within a waste container such that: 1) the garbage bag sling is positioned between a trash bag and the waste container; and, 2) the garbage bag sling is beneath the trash bag during normal use. The trash bag is then removed from the waste container by lifting the garbage bag sling out of the waste container.

20 Claims, 9 Drawing Sheets

(56) References Cited

U.S. PATENT DOCUMENTS

| | | | | |
|---|---|---|---|---|
| 8,640,890 | B2 * | 2/2014 | Schiller | B65B 67/1227 211/12 |
| 8,770,432 | B2 * | 7/2014 | Rueckheim | A47L 13/58 206/504 |
| 2006/0226152 | A1 * | 10/2006 | Barber | B65F 1/06 220/495.06 |
| 2009/0101605 | A1 * | 4/2009 | Goodfellow | B42F 15/0035 211/46 |
| 2009/0317022 | A1 * | 12/2009 | MacKay | B65D 25/16 383/71 |
| 2015/0344182 | A1 * | 12/2015 | Malin | B65D 5/48048 206/299 |

* cited by examiner

GARBAGE BAG SLING

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of transporting including the containers for the handling of thin or filamentary materials, more specifically, a flexible elongated element used for the or supporting of an article.

Waste containers intended for domestic and commercial use are often lined with trash bags. The trash bag forms a barrier between the contained waste and the interior of surfaces of the waste container. A common issue with a waste container lined with a trash bag is the over packing of waste into the lined waste container. When a trash bag is over packed within a waste container two unfortunate events can happen: 1) the trash bag can fail under the weight of the packed waste; and, 2) the over packing of the trash bag can expel air from between the trash bag and the interior surfaces of the waste container thereby creating a vacuum. The vacuum formed by the over packing creates a force that resists the removal of the trash bag from the waste container which further increases the risks of trash bag failure during the removal of the trash bag. Clearly, a method to simplify the removal of a trash bag from a waste container would be of benefit. This disclosure addresses the above issues.

SUMMARY OF INVENTION

The garbage bag sling is adapted for use with a trash bag. The garbage bag sling is adapted for use with a waste container. The garbage bag sling is placed within a waste container such that: 1) the garbage bag sling is positioned between the trash bag and the waste container; and, 2) the garbage bag sling is beneath the trash bag during normal use. The garbage bag sling is suspended from the open upper edge of the waste container. The trash bag is removed from the waste container by lifting the garbage bag sling out of the waste container. The garbage bag sling supports the bottom surface of the trash bag during extraction thereby reducing the risk of trash bag failure. In addition, the positioning of the trash bag sling between the trash bag and the interior surfaces allows the user to break any vacuum created by the trash bag by pulling the trash bag sling towards the center of the waste container. The garbage bag sling comprises a plurality of webbings, a plurality of fasteners, a plurality of hooks, a plurality of handles, a mesh sheeting, and a plurality of seams. The plurality of seams are used to interconnect the plurality of webbings, the plurality of fasteners, the plurality of handles, and the mesh sheeting. The plurality of fasteners attach the plurality of hooks to the interconnected structure. The plurality of hooks attach the garbage bag sling to the waste container.

These together with additional objects, features and advantages of the garbage bag sling will be readily apparent to those of ordinary skill in the art upon reading the following detailed description of the presently preferred, but nonetheless illustrative, embodiments when taken in conjunction with the accompanying drawings.

In this respect, before explaining the current embodiments of the garbage bag sling in detail, it is to be understood that the garbage bag sling is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the garbage bag sling.

It is therefore important that the claims be regarded as including such equivalent construction insofar as they do not depart from the spirit and scope of the garbage bag sling. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
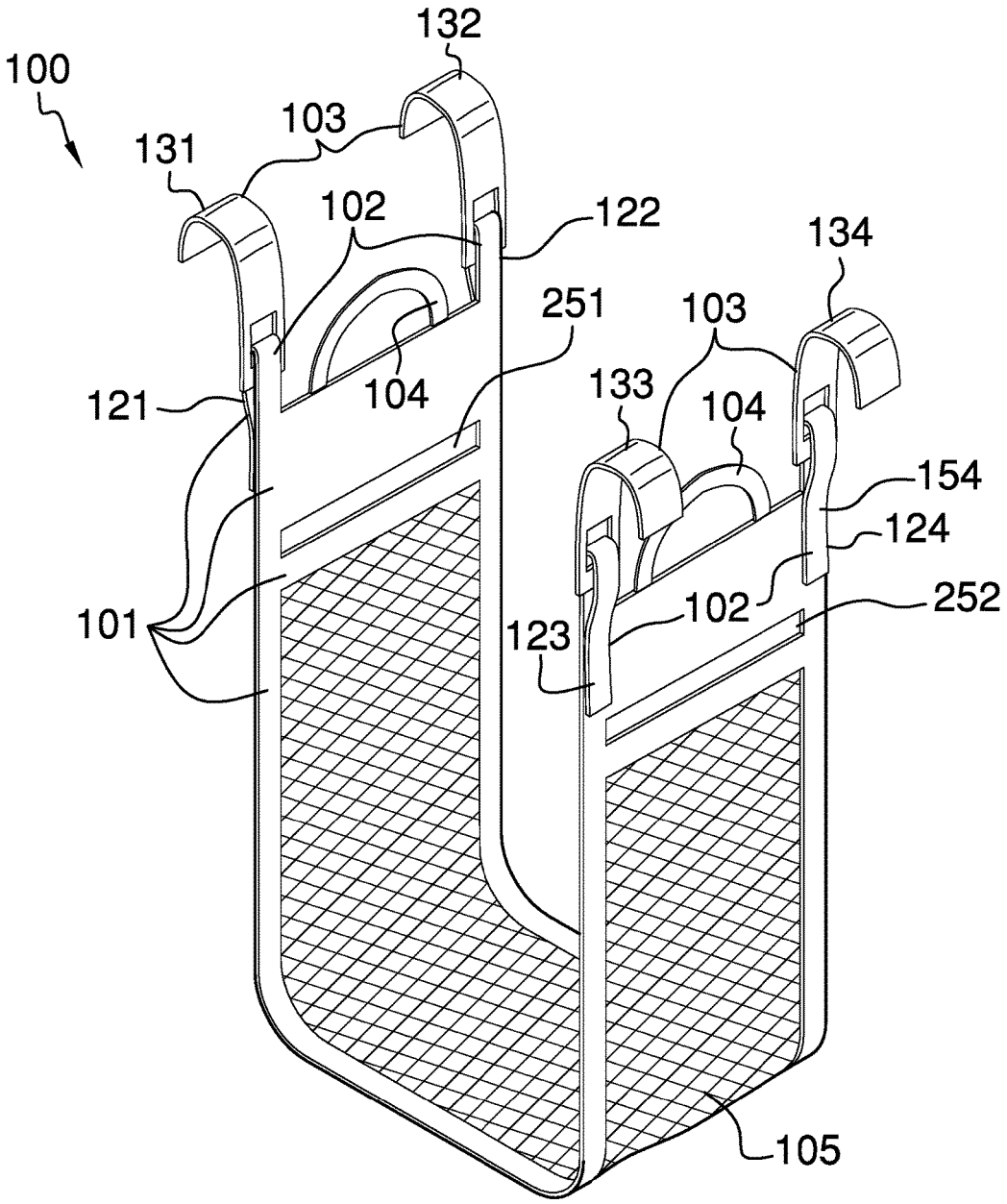
FIG. 1 is a perspective view of an embodiment of the disclosure.
Figure 2:
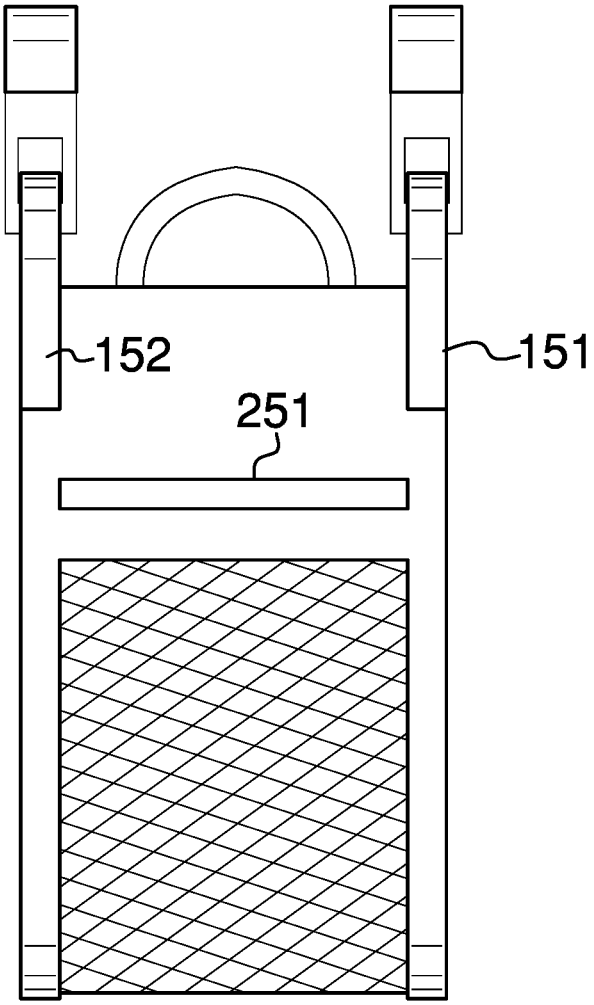
FIG. 2 is a side view of an embodiment of the disclosure.
Figure 3:
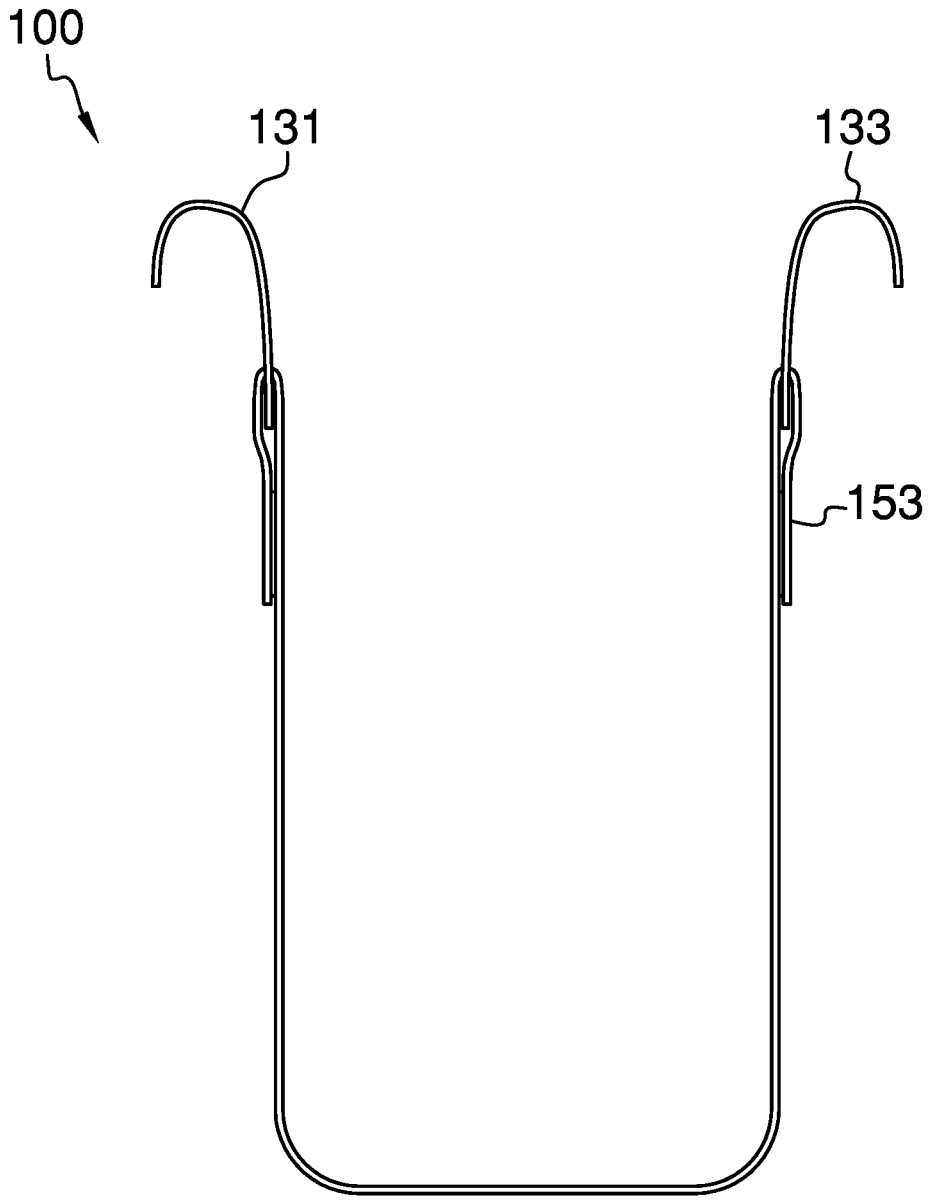
FIG. 3 is a front view of an embodiment of the disclosure.
Figure 4:
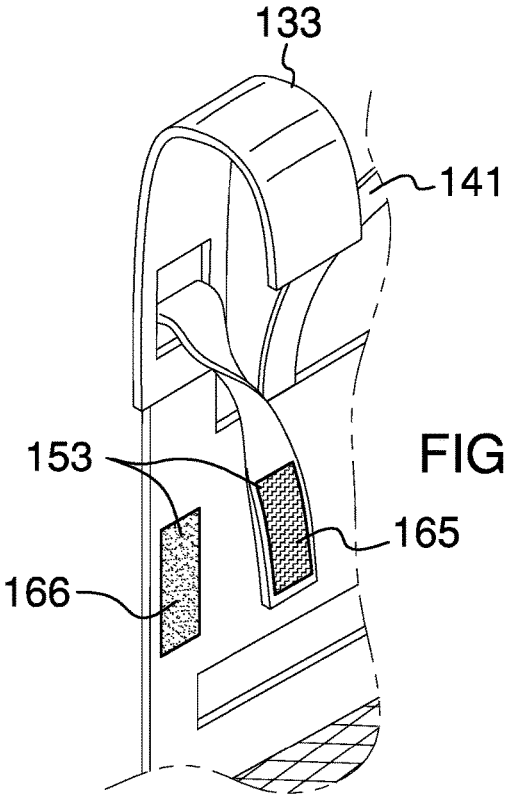
FIG. 4 is a detail view of an embodiment of the disclosure.
Figure 5:
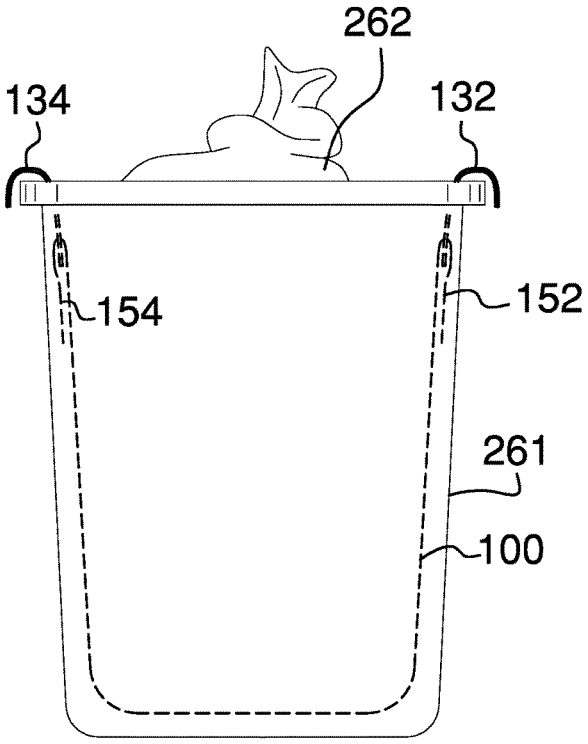
FIG. 5 is an in use view of an embodiment of the disclosure.
Figure 6:
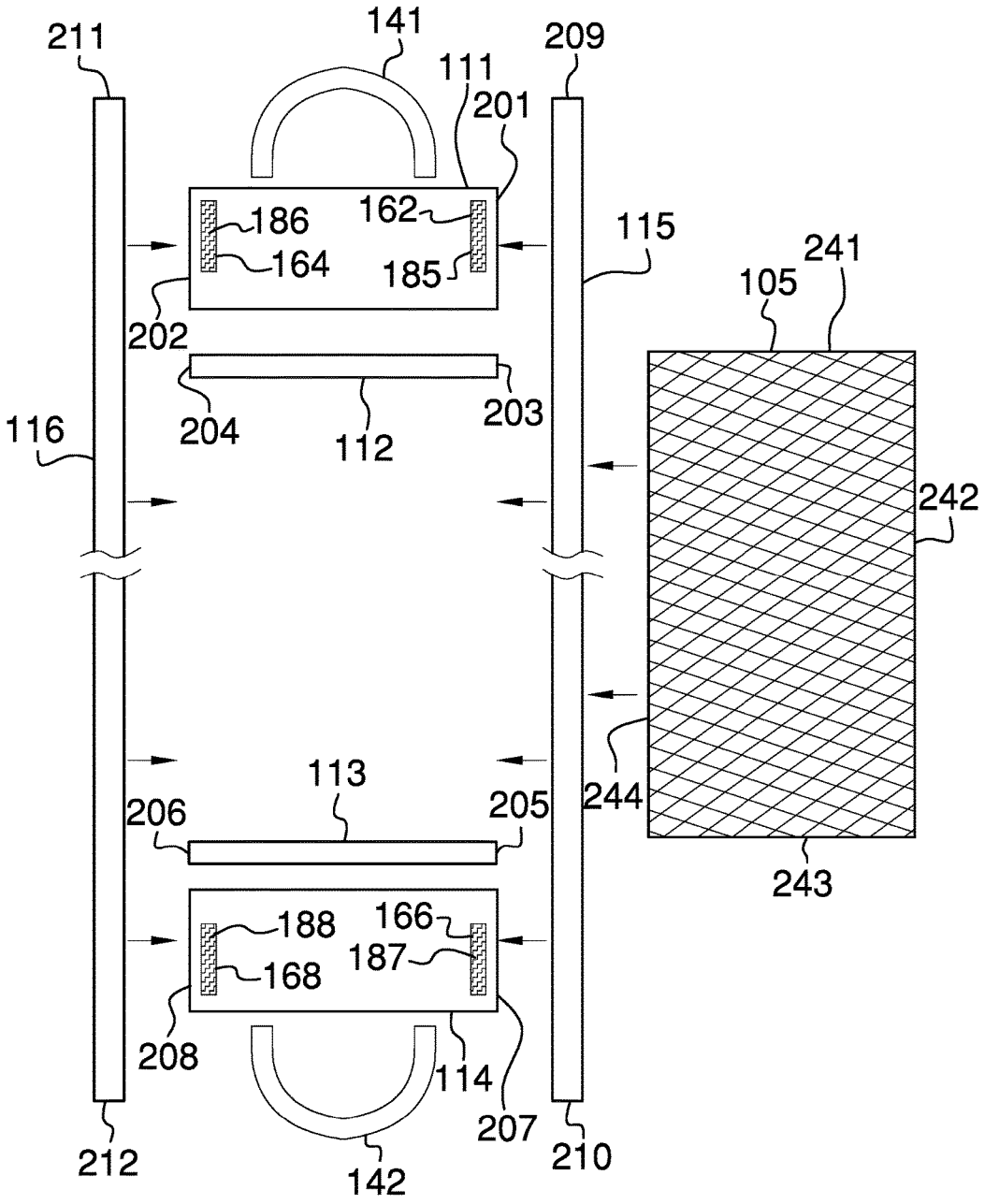
FIG. 6 is an exploded view of an embodiment of the disclosure.
Figure 7:
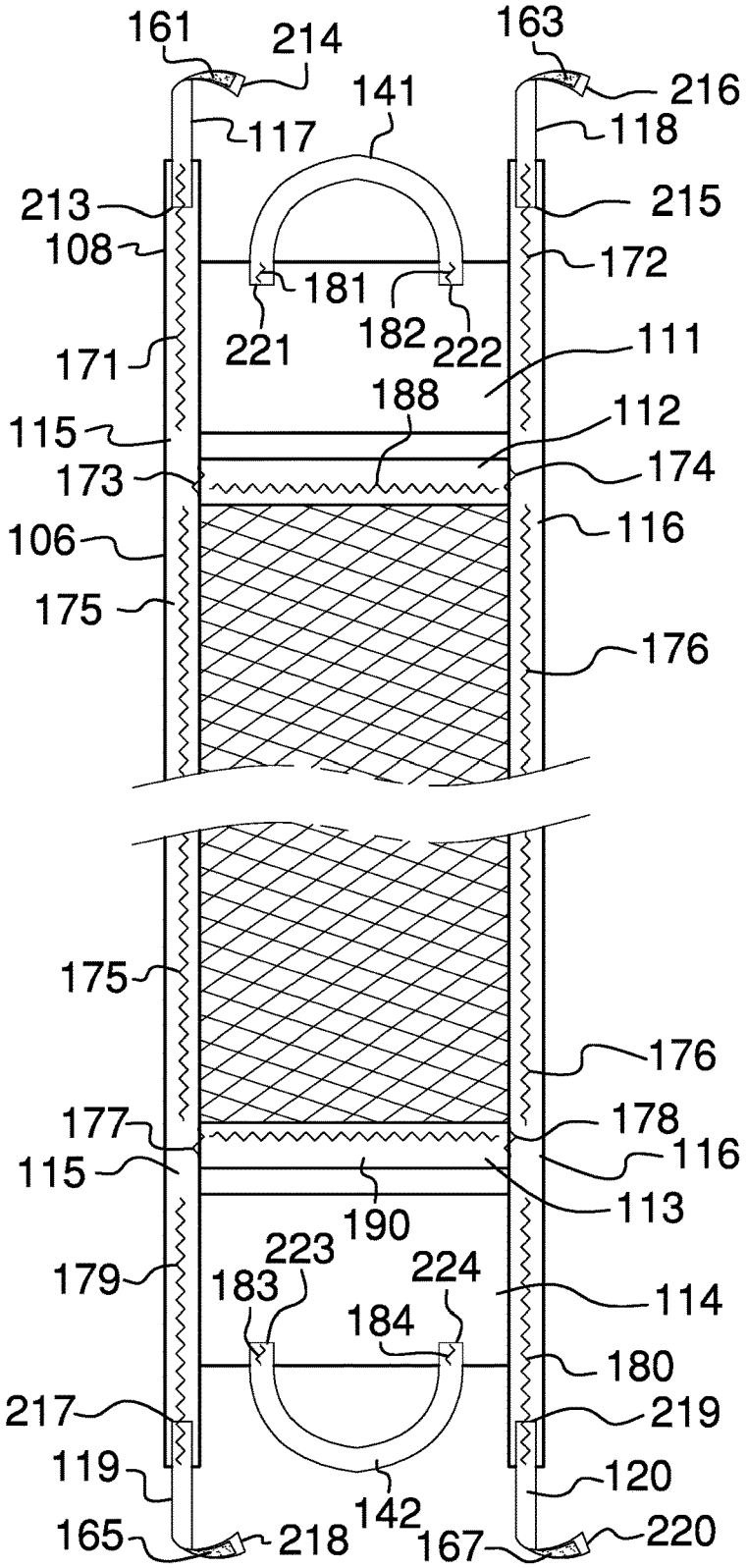
FIG. 7 is a reverse assembled detail view of an embodiment of the disclosure.
Figure 8:
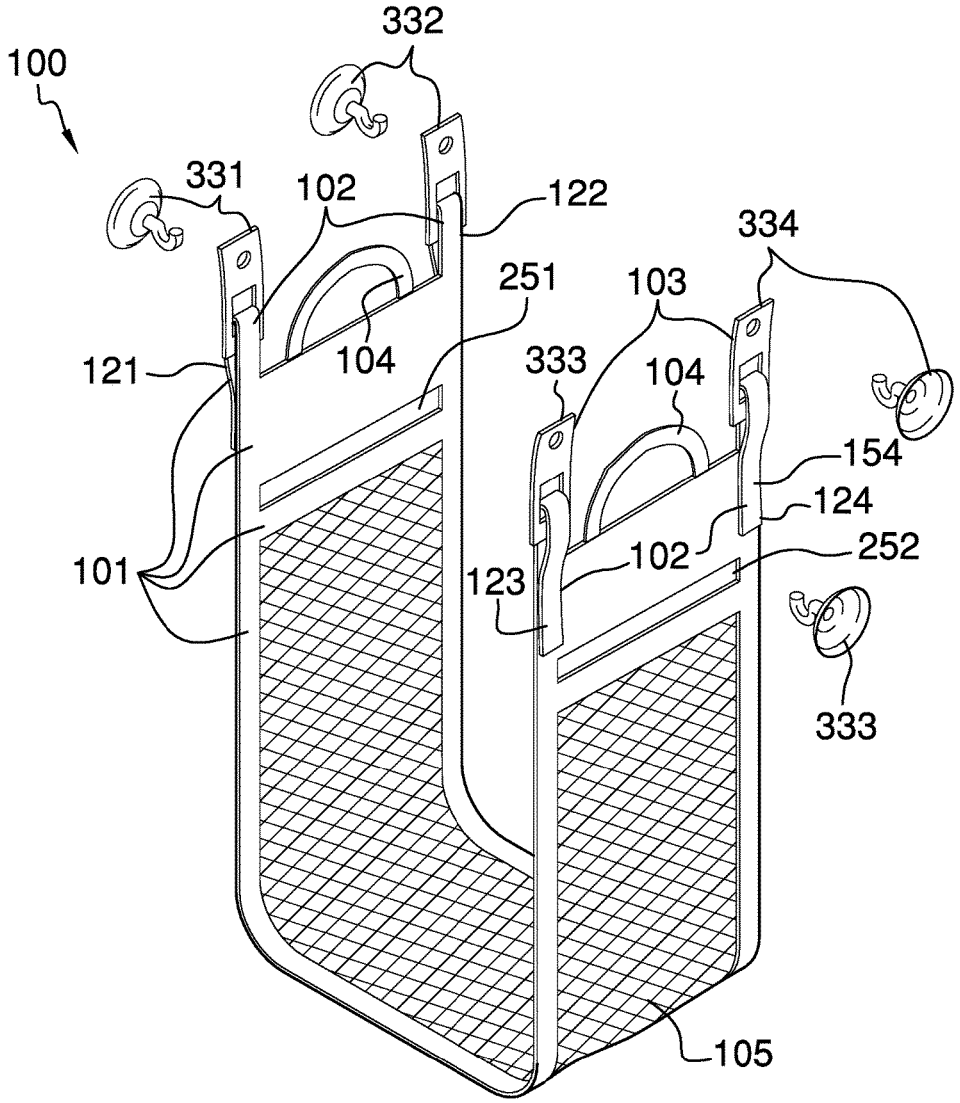
FIG. 8 is a perspective view of an alternative embodiment of the disclosure.
Figure 9:
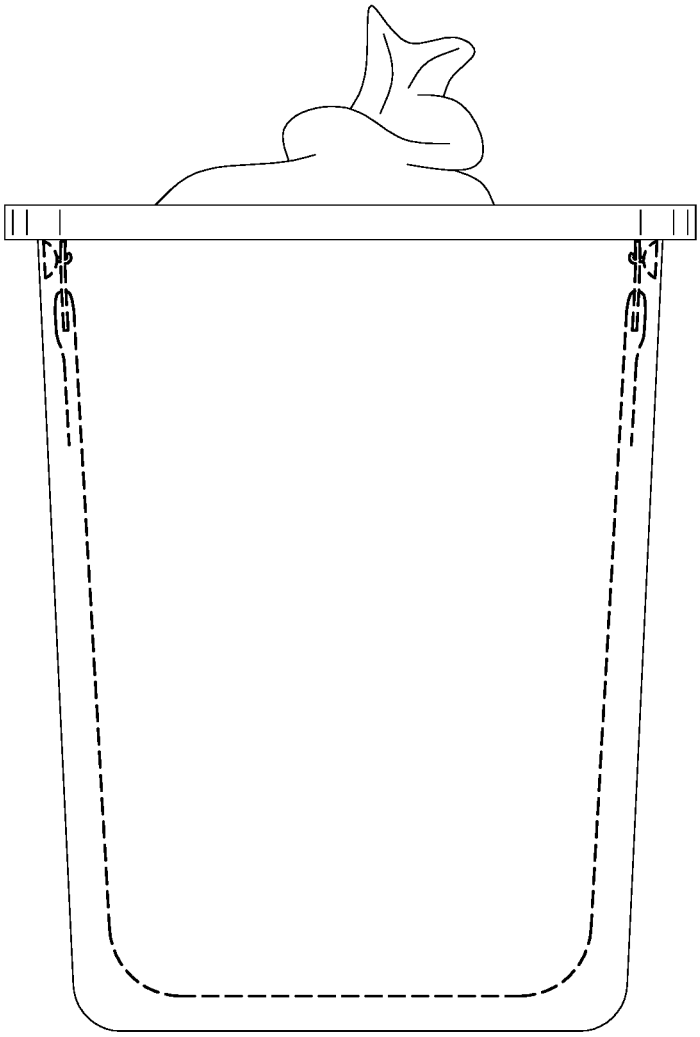
FIG. 9 is a side view of an embodiment of the disclosure in use.
Figure 10:
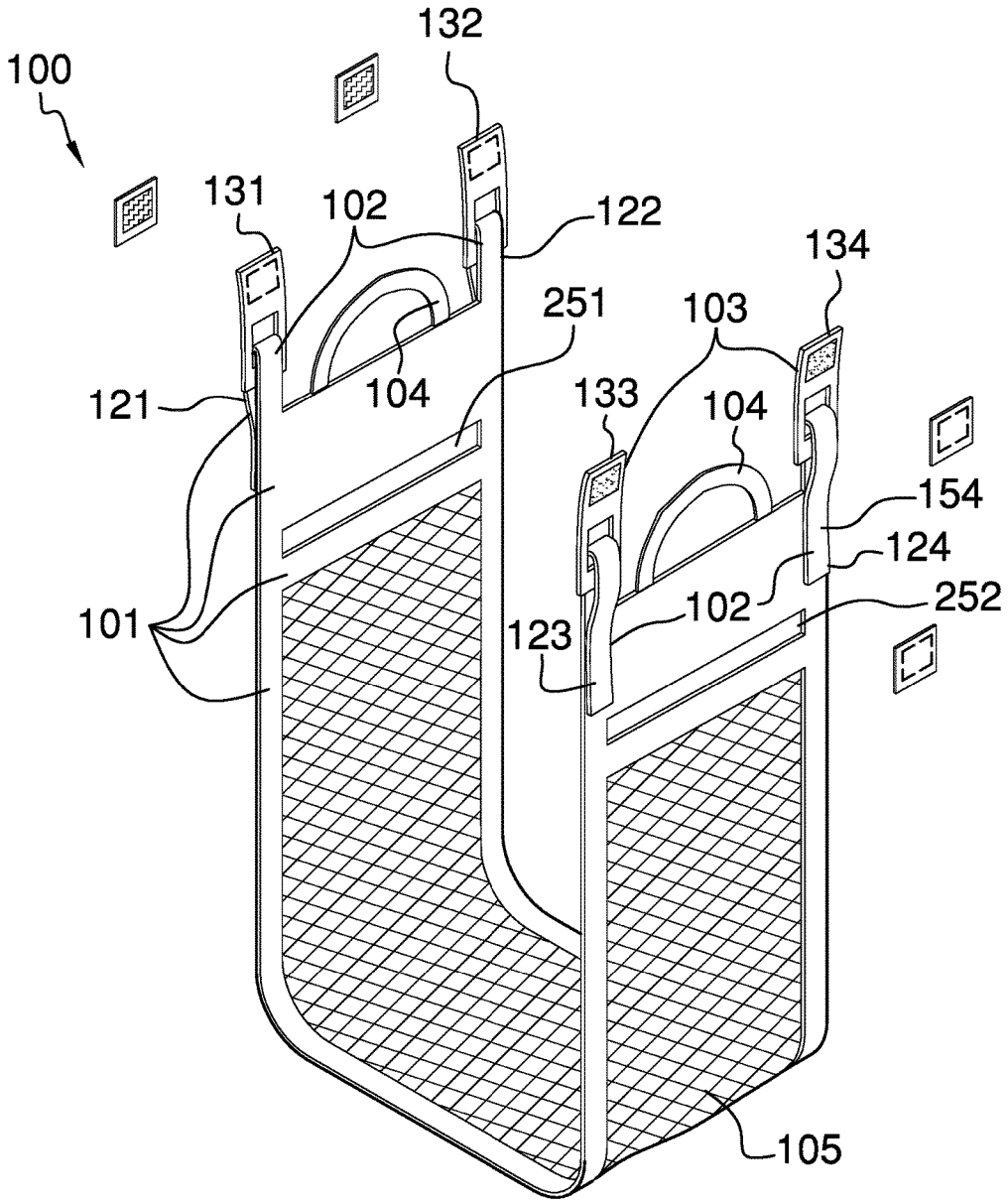
FIG. 10 is a perspective view of an alternative embodiment of the disclosure.

Detailed reference will now be made to one or more potential embodiments of the disclosure, which are illustrated in FIGS. 1 through 10.

The garbage bag sling 100 (hereinafter invention) is adapted for use with a trash bag 262. The invention 100 is adapted for use with a waste container 261. The invention 100 is placed within a waste container 261 such that: 1) the invention 100 is positioned between the trash bag 262 and the waste container 261; and, 2) the invention 100 is beneath the trash bag 262 during normal use. The invention 100 is suspended from the open upper edge of the waste container 261. The trash bag 262 is removed from the waste container 261 by lifting the invention 100 out of the waste container 261. The invention 100 supports the bottom surface of the trash bag 262 during extraction thereby reducing the risk of trash bag 262 failure. In addition, the positioning of the invention 100 between the trash bag 262 and the interior surfaces allows the user to break any vacuum created by the trash bag 262 by pulling the invention 100 towards the center of the waste container 261. The invention 100 comprises a plurality of webbings 101, a plurality of fasteners 102, a plurality of hooks 103, a plurality of handles 104, a mesh sheeting 105, and a plurality of seams 106. The plurality of seams 106 are used to interconnect the plurality of webbings 101, the plurality of fasteners 102, the plurality of handles 104, and the mesh sheeting 105. The plurality of fasteners 102 attach the plurality of hooks 103 to the interconnected structure. The plurality of hooks 103 attach the invention 100 to the waste container 261. The waste container 261 is commonly referred to as a trash can. The trash bag 262 is a commercially available trash can liner.

Each of the plurality of webbings 101 is a readily and commercially available textile webbing that is assembled into a sling structure. Each of the plurality of webbings 101 is treated with perfluorobutanesulfonic acid (CAS 375-73-5). The plurality of webbings 101 comprises a first webbing 111, a second webbing 112, a third webbing 113, a fourth webbing 114, a fifth webbing 115, a sixth webbing 116, a seventh webbing 117, an eighth webbing 118, a ninth webbing 119, and a tenth webbing 120.

The first webbing 111 is further defined with a first end 201 and a second end 202. The second webbing 112 is further defined with a third end 203 and a fourth end 204. The third webbing 113 is further defined with a fifth end 205 and a sixth end 206. The fourth webbing 114 is further defined with a seventh end 207 and an eighth end 208. The fifth webbing 115 is further defined with a ninth end 209 and a tenth end 210. The sixth webbing 116 is further defined with an eleventh end 211 and a twelfth end 212. The seventh webbing 117 is further defined with a thirteenth end 213 and a fourteenth end 214. The eighth webbing 118 is further defined with a fifteenth end 215 and a sixteenth end 216. The ninth webbing 119 is further defined with a seventeenth end 217 and an eighteenth end 218. The tenth webbing 120 is further defined with a nineteenth end 219 and a twentieth end 220.

Each of the plurality of fasteners 102 attaches a hook selected from the plurality of fasteners 102 to a webbing selected from the plurality of webbings 101. The plurality of fasteners 102 comprises a first fastener 121, a second fastener 122, a third fastener 123, and a fourth fastener 124. The first fastener 121 is a readily and commercially available fastening device. The second fastener 122 is a readily and commercially available fastening device. The third fastener 123 is a readily and commercially available fastening device. The fourth fastener 124 is a readily and commercially available fastening device.

In the first potential embodiment of the disclosure, the first fastener 121 comprises a first hook and loop fastener 151. The second fastener 122 comprises a second hook and loop fastener 152. The third fastener 123 comprises a third hook and loop fastener 153. The fourth fastener 124 comprises a fourth hook and loop fastener 154.

The first hook and loop fastener 151 is further defined with a first hook or loop surface 161 and a second hook or loop surface 162. The second hook and loop fastener 152 is further defined with a third hook or loop surface 163 and a fourth hook or loop surface 164. The third hook and loop fastener 153 is further defined with a fifth hook or loop surface 165 and a sixth hook or loop surface 166. The fourth hook and loop fastener 154 is further defined with a seventh hook or loop surface 167 and an eighth hook or loop surface 168.

Each of the plurality of hooks 103 attaches the sling formed by the plurality of webbings 101 to the waste container 261. Each of the plurality of hooks 103 is identical. Each of the plurality of hooks 103 is a curved structure that can be hung from the upper lip of the waste container 261. The plurality of hooks 103 comprises a first hook 131, a second hook 132, a third hook 133, and a fourth hook 134.

The first hook 131 is a curved structure that intended to be hung from the waste container 261. The first hook 131 is formed with a first hole to which the first fastener 121 is attached. The second hook 132 is a curved structure that intended to be hung from the waste container 261. The second hook 132 is formed with a second hole to which the second fastener 122 is attached. The third hook 133 is a curved structure that intended to be hung from the waste container 261. The third hook 133 is formed with a third hole to which the third fastener 123 is attached. The fourth hook 134 is a curved structure that intended to be hung from the waste container 261. The fourth hook 134 is formed with a fourth hole to which the fourth fastener 124 is attached.

The first hook and loop fastener 151 is a readily and commercially hook and loop fastening device. The second hook and loop fastener 152 is a readily and commercially hook and loop fastening device. The third hook and loop fastener 153 is a readily and commercially hook and loop fastening device. The fourth hook and loop fastener 154 is a readily and commercially hook and loop fastening device.

The first hook or loop surface 161 is a hook or loop surface associated with the first hook and loop fastener 151. The second hook or loop surface 162 is a hook or loop surface associated with the first hook and loop fastener 151. The third hook or loop surface 163 is a hook or loop surface associated with the second hook and loop fastener 152. The fourth hook or loop surface 164 is a hook or loop surface associated with the second hook and loop fastener 152. The fifth hook or loop surface 165 is a hook or loop surface associated with the third hook and loop fastener 153. The sixth hook or loop surface 166 is a hook or loop surface associated with the third hook and loop fastener 153. The seventh hook or loop surface 167 is a hook or loop surface associated with the fourth hook and loop fastener 154. The eighth hook or loop surface 168 is a hook or loop surface associated with the fourth hook and loop fastener 154.

Each of the plurality of handles 104 is a grip that can be used to raise the invention 100 out of the waste container 261. The plurality of handles 104 comprises a first handle 141 and a second handle 142. The first handle 141 is further defined with a twenty first end 221 and a twenty second end 222. The second handle 142 is further defined with a twenty third end 223 and a twenty fourth end 224.

The first handle 141 is a textile material that is roughly cut in the shape of the perimeter of a semicircle. The second handle 142 is a textile material that is roughly cut in the shape of the perimeter of a semicircle.

The mesh sheeting 105 is a readily and commercially available sheeting material that is formed as a mesh. In the first potential embodiment of the disclosure, the mesh sheeting 105 is formed from polyester yarns treated with perfluorobutanesulfonic acid (CAS 375-73-5). The mesh sheeting 105 is further defined with a first edge 241, a second edge 242, a third edge 243, and a fourth edge 244.

The plurality of seams 106 comprises a collection of individual seams that are used to assemble the invention 100. The plurality of seams 106 comprises a first seam 171, a second seam 172, a third seam 173, a fourth seam 174, a fifth seam 175, a sixth seam 176, a seventh seam 177, an eighth seam 178, a ninth seam 179, a tenth seam 180, an eleventh seam 181, a twelfth seam 182, a thirteenth seam 183, a fourteenth seam 184, a fifteenth seam 185, a sixteenth seam 186, a seventeenth seam 187, an eighteenth seam 188, a nineteenth seam 189, and a twentieth seam 190.

In the first potential embodiment of the disclosure, the first seam 171 is a sewn seam. The second seam 172 is a sewn seam. The third seam 173 is a sewn seam. The fourth seam 174 is a sewn seam. The fifth seam 175 is a sewn seam. The sixth seam 176 is a sewn seam. The seventh seam 177 is a sewn seam. The eighth seam 178 is a sewn seam. The ninth seam 179 is a sewn seam. The tenth seam 180 is a sewn seam. The eleventh seam 181 is a sewn seam. The twelfth seam 182 is a sewn seam. The thirteenth seam 183 is a sewn seam. The fourteenth seam 184 is a sewn seam. The fifteenth seam 185 is a sewn seam. The sixteenth seam 186 is a sewn seam. The seventeenth seam 187 is a sewn seam. The eighteenth seam 188 is a sewn seam. The nineteenth seam 189 is a sewn seam. The twentieth seam 190 is a sewn seam.

The assembly of the invention 100 is described in the following 8 paragraphs.

The first seam 171 attaches the ninth end 209 of the fifth webbing 115 to both the first end 201 of the first webbing 111 and the thirteenth end 213 of the seventh webbing 117. The second seam 172 attaches the eleventh end 211 of the sixth webbing 116 to both the second end 202 of the first webbing 111 and the fifteenth end 215 of the eighth webbing 118. The third seam 173 attaches the third end 203 of the second webbing 112 to the face of the fifth webbing 115. The fourth seam 174 attaches the fourth end 204 of the second webbing 112 to the face of the sixth webbing 116.

The second webbing 112 attaches to the fifth webbing 115 and the sixth webbing 116 such that a space is formed between the second webbing 112 and the first webbing 111. The space between the second webbing 112 and the first webbing 111 is called the first aperture 251. The first hook and loop fastener 151 and the second hook and loop fastener 152 are secured to the first aperture 251 when the plurality of hooks 103 are not attached to the invention 100.

The fifth seam 175 attaches the second edge 242 of the mesh sheeting 105 to the face of the fifth webbing 115. The sixth seam 176 attaches the fourth edge 244 of the mesh sheeting 105 to the face of the sixth webbing 116. The seventh seam 177 attaches the fifth end 205 of the third webbing 113 to the face of the fifth webbing 115. The eighth seam 178 attaches the sixth end 206 of the third webbing 113 to the face of the sixth webbing 116.

The third webbing 113 attaches to the fifth webbing 115 and the sixth webbing 116 such that a space is formed between the third webbing 113 and the fourth webbing 114. The space between the third webbing 113 and the fourth webbing 114 is called the second aperture 252. The third hook and loop fastener 153 and the fourth hook and loop fastener 154 are secured to the second aperture 252 when the plurality of hooks 103 are not attached to the invention 100.

The ninth seam 179 attaches the tenth end 210 of the fifth webbing 115 to both the seventh end 207 of the fourth webbing 114 and the seventeenth end 217 of the ninth webbing 119. The tenth seam 180 attaches the twelfth end 212 of the sixth webbing to both the eighth end 208 of the fourth webbing 114 and the nineteenth end 219 of the tenth webbing 120.

The eleventh seam 181 attaches the twenty first end 221 of the first handle 141 to the face of the first webbing 111. The twelfth seam 182 attaches the twenty second end 222 of the first handle 141 to the face of the first webbing 111. The thirteenth seam 183 attaches the twenty third end 223 of the second handle 142 to the face of the fourth webbing 114. The fourteenth seam 184 attaches the twenty fourth end 224 of the second handle 142 to the face of the fourth webbing 114.

The fifteenth seam 185 attaches the second hook or loop surface 162 to the face of the first webbing 111. The sixteenth seam 186 attaches the fourth hook or loop surface 164 to the face of the first webbing 111. The seventeenth seam 187 attaches the sixth hook or loop surface 166 to the face of the fourth webbing 114. The eighteenth seam 188 attaches the eighth hook or loop surface 168 to the face of the fourth webbing 114. The nineteenth seam 189 attaches the first edge 241 of the mesh sheeting 105 to the face of the second webbing 112. The twentieth seam 190 attaches the third edge 243 of the mesh sheeting 105 to the face of the third webbing 113.

The first hook or loop surface 161 attaches to the fourteenth end 214 of the seventh webbing 117 using an adhesive webbing. The third hook or loop surface 163 attaches to the sixteenth end 216 of the eighth webbing 118 using an adhesive webbing. The fifth hook or loop surface 165 attaches to the eighteenth end 218 of the ninth webbing 119 using an adhesive webbing. The seventh hook or loop surface 167 attaches to the twentieth end 220 of the tenth webbing 120 using an adhesive webbing.

The use of the invention 100 is discussed in the following two paragraphs.

The first fastener 121 attaches the first hook 131 to the invention 100. The second fastener 122 attaches the second hook 132 to the invention 100. The third fastener 123 attaches the third hook 133 to the invention 100. The fourth fastener 124 attaches the fourth hook 134 to the invention 100. The first hook 131, the second hook 132, the third hook 133, and the fourth hook 134 are used to suspend the invention 100 into the waste container 261.

The trash bag 262 is inserted into the interior of the waste container 261 such that the mesh sheeting 105 is positioned between the trash bag 262 and the interior surface of the waste container 261. When the trash bag 262 is to be removed from the waste container 261, the invention 100 is raised out of the waste container 261 using the first handle 141 and the second handle 142 such that the trash bag 262 is removed from the waste container 261.

In a second potential embodiment of the disclosure, the plurality of hook 103 is replaced with a plurality of suction cups 303.

Each of the plurality of suction cups 303 attaches the sling formed by the plurality of webbings 101 to the waste container 261. Each of the plurality of suction cups 303 is identical. Each of the plurality of suction cups 303 is a structure that can be hung from the upper lip of the waste container 261. The plurality of suction cups 303 comprises a first suction cup structure 331, a second suction cup structure 332, a third suction cup structure 333, and a fourth suction cup structure 334.

The first suction cup structure 331 replaces the first hook 131. The first suction cup 331 is a suction structure that intended to be hung from the waste container 261. The first suction cup 331 is formed with a metal plate and a suction cup. The suction cup attaches the metal plate to the side of the waste container. The suction cup is an apparatus that creates a partial vacuum relative to the atmosphere between the surface of the suction cup and the surface of the waste container 261. This pressure differential between the partial vacuum and the atmospheric pressure provides the force necessary to secure the invention 100 to the surface of the waste container 261. The first suction cup structure 331 attaches to the first fastener 121 in a manner identical to the first potential embodiment of the disclosure.

The second suction cup structure 332 replaces the second hook 132. The structure of the second suction cup structure 332 is identical to the first suction cup structure 331. The second suction cup structure 332 attaches to the second fastener 122 in a manner identical to the first potential embodiment of the disclosure.

The third suction cup structure 333 replaces the third hook 132. The structure of the third suction cup structure 333 is identical to the first suction cup structure 331. The third suction cup structure 333 attaches to the third fastener 123 in a manner identical to the first potential embodiment of the disclosure.

The fourth suction cup structure 334 replaces the fourth hook 134. The structure of the fourth suction cup structure 334 is identical to the first suction cup structure 331. The fourth suction cup structure 334 attaches to the fourth fastener 124 in a manner identical to the first potential embodiment of the disclosure.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Domestic Article: As used in this disclosure, a domestic article is an item or object: 1) that is commonly found within a household; or, 2) that is commonly carried by a person. Examples of domestic articles include, but are not limited to, keys and key fobs, personal data devices, glasses, remote controls, or personal storage items such as purses, briefcases, wallets, or cases.

Fastener: As used in this disclosure, a fastener is a device that is used to join or affix two objects. Fasteners generally comprise a first element, which is attached to the first object and a second element which is attached to the second object such that the first element and the second element join to affix the first object and the second object. Common fasteners include, but are not limited to, hooks, zippers, snaps, buttons, buckles, quick release buckles, or hook and loop fasteners.

Grip: As used in this disclosure, a grip is an accommodation formed within an object that allows the object to be grasped or manipulated by a hand.

Handle: As used in this disclosure, a handle is an object by which a tool, object, or door is held or manipulated with the hand.

Hang: As used in this disclosure, to hang an object is to suspend an object above a surface from above such that the inferior end of the object can move freely.

Hook: As used in this disclosure, a hook is an object that is curved or bent at an angle such that items can be hung on or caught by the object.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook or loop surface" with the understanding that when the two objects are fastened together one of the two objects will have a hook surface and the remaining object will have the loop surface.

Mesh: As used in this disclosure, the term mesh refers to an openwork fabric made from threads, yarns, cords, wires, or lines that are woven, knotted, or otherwise twisted or intertwined at regular intervals. Synonyms for mesh include net.

Perfluorobutanesulfonic acid: As used in this disclosure, perfluorobutanesulfonic acid (CAS 375-73-5) is a surfactant, technically a fluorosurfactant, which is commonly applied to a textile as a water repellant.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheeting: As used in this disclosure, sheeting is a material, such as a textile, a plastic, or a metal foil, in the form of a thin flexible layer or layers.

Sling: As used in this disclosure, a sling refers to a structure that is used to support, cradle or hoist an object, generally from above.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Suction Cup: As used in this disclosure, a suction cup means an object or device that uses negative fluid pressure of air or water to adhere to nonporous surfaces by creating a partial vacuum.

Textile: As used in this disclosure, a textile is a material that is woven, knitted, braided or felted. Synonyms in common usage for this definition include fabric and cloth.

Trash Bag: As used in this disclosure, a trash bag is a disposable bag formed from a sheeting that is used to contain trash and other refuse for in a manner suitable for disposal. Trash bags are often used to line a waste container.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

With respect to the above description, it is to be realized that the optimum dimensional relationship for the various components of the invention described above and in FIGS. 1 through 10 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An apparatus comprising:

wherein the apparatus comprises a plurality of webbings, a plurality of fasteners, a plurality of anchors, a plurality of handles, a mesh sheeting, and a plurality of seams;

wherein the plurality of seams are used to interconnect the plurality of webbings, the plurality of fasteners, the plurality of handles, and the mesh sheeting;

wherein the plurality of fasteners attach the plurality of hooks to the interconnected structure;

wherein the plurality of hooks attach the apparatus to the waste container;

wherein the apparatus is adapted for use with a trash bag;

wherein the apparatus is adapted for use with a waste container, and wherein the apparatus is placed within a waste container such the apparatus is positioned between the trash bag and the waste container;

wherein the apparatus is placed beneath the trash bag during normal use;

wherein the apparatus is suspended from an open upper edge of the waste container;

wherein the trash bag is removed from the waste container by lifting the apparatus out of the waste container.

2. The apparatus according to claim 1 wherein each of the plurality of webbings is a textile webbing;

wherein each of the plurality of webbings is assembled into a sling structure;

wherein the plurality of webbings comprises a first webbing, a second webbing, a third webbing, a fourth webbing, a fifth webbing, a sixth webbing, a seventh webbing, an eighth webbing, a ninth webbing, and a tenth webbing;

wherein each of the plurality of webbings is treated with perfluorobutanesulfonic acid (CAS 375-73-5);

wherein the first webbing is further defined with a first end and a second end;

wherein the second webbing is further defined with a third end and a fourth end;

wherein the third webbing is further defined with a fifth end and a sixth end;

wherein the fourth webbing is further defined with a seventh end and an eighth end;

wherein the fifth webbing is further defined with a ninth end and a tenth end;

wherein the sixth webbing is further defined with an eleventh end and a twelfth end;

wherein the seventh webbing is further defined with a thirteenth end and a fourteenth end;

wherein the eighth webbing is further defined with a fifteenth end and a sixteenth end;

wherein the ninth webbing is further defined with a seventeenth end and an eighteenth end;

wherein the tenth webbing is further defined with a nineteenth end and a twentieth end.

3. The apparatus according to claim 2 wherein each of the plurality of fasteners attaches an anchor selected from the plurality of anchors to a webbing selected from the plurality of webbings;

wherein the plurality of fasteners comprises a first fastener, a second fastener, a third fastener, and a fourth fastener.

4. The apparatus according to claim 3 wherein each of the plurality of anchors attaches the sling formed by the plurality of webbings to the waste container;

wherein each of the plurality of anchors is identical.

5. The apparatus according to claim 4 wherein each of the plurality of handles is a grip that can be used to raise the apparatus out of the waste container.

6. The apparatus according to claim 5 wherein the mesh sheeting is a sheeting material that is formed as a mesh;

wherein the mesh sheeting is attached to the plurality of webbings;

wherein the mesh sheeting is further defined with a first edge, a second edge, a third edge, and a fourth edge;

the mesh sheeting is formed from polyester yarns treated with perfluorobutanesulfonic acid (CAS 375-73-5).

7. The apparatus according to claim 6 wherein the first fastener comprises a first hook and loop fastener;

wherein the second fastener comprises a second hook and loop fastener;

wherein the third fastener comprises a third hook and loop fastener;

wherein the fourth fastener comprises a fourth hook and loop fastener;

wherein the first hook and loop fastener is further defined with a first hook or loop surface and a second hook or loop surface;

wherein the second hook and loop fastener is further defined with a third hook or loop surface and a fourth hook or loop surface;

wherein the third hook and loop fastener is further defined with a fifth hook or loop surface and a sixth hook or loop surface;

wherein the fourth hook and loop fastener is further defined with a seventh hook or loop surface and an eighth hook or loop surface.

8. The apparatus according to claim 7 wherein each of the plurality of anchors is selected from the group consisting of a hook or a suction cup;

wherein the plurality of anchors comprises a first anchor, a second anchor, a third anchor, and a fourth anchor.

9. The apparatus according to claim 8
wherein the plurality of handles comprises a first handle and a second handle;
wherein the first handle is attached to a webbing selected from the plurality of webbings;
wherein the second handle is attached to a webbing selected form the plurality of webbings;
wherein the first handle is further defined with a twenty first end and a twenty second end;
wherein the second handle is further defined with a twenty third end and a twenty fourth end.

10. The apparatus according to claim 9
wherein the first handle is a curved textile material;
wherein the second handle is a curved textile material.

11. The apparatus according to claim 10
wherein the plurality of seams comprises a collection of individual seams that are used to assemble the apparatus;
wherein the plurality of seams comprises a first seam, a second seam, a third seam, a fourth seam, a fifth seam, a sixth seam, a seventh seam, an eighth seam, a ninth seam, a tenth seam, an eleventh seam, a twelfth seam, a thirteenth seam, a fourteenth seam, a fifteenth seam, a sixteenth seam, a seventeenth seam, an eighteenth seam, a nineteenth seam, and a twentieth seam.

12. The apparatus according to claim 11
wherein the first seam attaches the ninth end of the fifth webbing to both the first end of the first webbing and the thirteenth end of the seventh webbing;
wherein the second seam attaches the eleventh end of the sixth webbing to both the second end of the first webbing and the fifteenth end of the eighth webbing;
wherein the third seam attaches the third end of the second webbing to the face of the fifth webbing;
wherein the fourth seam attaches the fourth end of the second webbing to the face of the sixth webbing;
wherein the seventh seam attaches the fifth end of the third webbing to the face of the fifth webbing;
wherein the eighth seam attaches the sixth end of the third webbing to the face of the sixth webbing;
wherein the ninth seam attaches the tenth end of the fifth webbing to both the seventh end of the fourth webbing and the seventeenth end of the ninth webbing;
wherein the tenth seam attaches the twelfth end of the sixth webbing to both the eighth end of the fourth webbing and the nineteenth end of the tenth webbing.

13. The apparatus according to claim 12
wherein the second webbing attaches to the fifth webbing and the sixth webbing such that a space is formed between the second webbing and the first webbing;
wherein the space between the second webbing and the first webbing is called the first aperture;
wherein the first hook and loop fastener and the second hook and loop fastener are secured to the first aperture when the plurality of hooks are not attached to the apparatus;
wherein the third webbing attaches to the fifth webbing and the sixth webbing such that a space is formed between the third webbing and the fourth webbing;
wherein the space between the third webbing and the fourth webbing is called the second aperture;
wherein the third hook and loop fastener and the fourth hook and loop fastener are secured to the second aperture when the plurality of hooks are not attached to the apparatus.

14. The apparatus according to claim 13
wherein the fifth seam attaches the second edge of the mesh sheeting to the face of the fifth webbing;
wherein the sixth seam attaches the fourth edge of the mesh sheeting to the face of the sixth webbing;
wherein the nineteenth seam attaches the first edge of the mesh sheeting to the face of the second webbing;
wherein the twentieth seam attaches the third edge of the mesh sheeting to the face of the third webbing.

15. The apparatus according to claim 14
wherein the eleventh seam attaches the twenty first end of the first handle to the face of the first webbing;
wherein the twelfth seam attaches the twenty second end of the first handle to the face of the first webbing;
wherein the thirteenth seam attaches the twenty third end of the second handle to the face of the fourth webbing;
wherein the fourteenth seam attaches the twenty fourth end of the second handle to the face of the fourth webbing.

16. The apparatus according to claim 15
wherein the fifteenth seam attaches the second hook or loop surface to the face of the first webbing;
wherein the sixteenth seam attaches the fourth hook or loop surface to the face of the first webbing;
wherein the seventeenth seam attaches the sixth hook or loop surface to the face of the fourth webbing;
wherein the eighteenth seam attaches the eighth hook or loop surface to the face of the fourth webbing;
wherein the first hook or loop surface attaches to the fourteenth end of the seventh webbing using an adhesive webbing;
wherein the third hook or loop surface attaches to the sixteenth end of the eighth webbing using an adhesive webbing;
wherein the fifth hook or loop surface attaches to the eighteenth end of the ninth webbing using an adhesive webbing;
wherein the seventh hook or loop surface attaches to the twentieth end of the tenth webbing using an adhesive webbing.

17. The apparatus according to claim 16
wherein the first fastener attaches the first anchor to the apparatus;
wherein the second fastener attaches the second anchor to the apparatus;
wherein the third fastener attaches the third anchor to the apparatus;
wherein the fourth fastener attaches the fourth anchor to the apparatus;
wherein the first anchor, the second anchor, the third anchor, and the fourth anchor are used to suspend the apparatus into the waste container.

18. The apparatus according to claim 17
wherein the first seam is a sewn seam;
wherein the second seam is a sewn seam;
wherein the third seam is a sewn seam;
wherein the fourth seam is a sewn seam;
wherein the fifth seam is a sewn seam;
wherein the sixth seam is a sewn seam;
wherein the seventh seam is a sewn seam;
wherein the eighth seam is a sewn seam;
wherein the ninth seam is a sewn seam;
wherein the tenth seam is a sewn seam;
wherein the eleventh seam is a sewn seam;
wherein the twelfth seam is a sewn seam;
wherein the thirteenth seam is a sewn seam;
wherein the fourteenth seam is a sewn seam;
wherein the fifteenth seam is a sewn seam;

wherein the sixteenth seam is a sewn seam;
wherein the seventeenth seam is a sewn seam;
wherein the eighteenth seam is a sewn seam;
wherein the nineteenth seam is a sewn seam;
wherein the twentieth seam is a sewn seam.

19. The apparatus according to claim 18 wherein each of the plurality of anchors is a hook;
wherein any hook selected from the plurality of anchors is a curved structure;
wherein the plurality of anchors comprises a first hook, a second hook, a third hook, and a fourth hook;
wherein the first hook is formed with a first hole to which the first fastener is attached;
wherein the second hook is formed with a second hole to which the second fastener is attached;
wherein the third hook is formed with a third hole to which the third fastener is attached;
wherein the fourth hook is formed with a fourth hole to which the fourth fastener is attached.

20. The apparatus according to claim 18 wherein each of the plurality of anchors is a suction cup;
wherein any suction cup selected from the plurality of anchors is a curved structure;
wherein the plurality of anchors comprises a first suction cup, a second suction cup, a third suction cup, and a fourth suction cup;
wherein the first suction cup is formed with a first hole to which the first fastener is attached;
wherein the second suction cup is formed with a second hole to which the second fastener is attached;
wherein the third suction cup is formed with a third hole to which the third fastener is attached;
wherein the fourth suction cup is formed with a fourth hole to which the fourth fastener is attached.

* * * * *